US011730294B1

(12) United States Patent
Aubert

(10) Patent No.: US 11,730,294 B1
(45) Date of Patent: Aug. 22, 2023

(54) MULTIPLE CHAMBER DISPENSER ASSEMBLY

(71) Applicant: Diana Aubert, Bronx, NY (US)

(72) Inventor: Diana Aubert, Bronx, NY (US)

( * ) Notice: Subject to any disclaimer, the term of this patent is extended or adjusted under 35 U.S.C. 154(b) by 0 days.

(21) Appl. No.: 17/690,524

(22) Filed: Mar. 9, 2022

(51) Int. Cl.
*B65D 25/04* (2006.01)
*A47G 19/24* (2006.01)
*B65D 47/08* (2006.01)

(52) U.S. Cl.
CPC ..... *A47G 19/24* (2013.01); *B65D 25/04* (2013.01); *B65D 47/0838* (2013.01)

(58) Field of Classification Search
CPC ..... B65D 25/04; B65D 47/08–0895; B65D 83/06; A47G 19/24; A47G 19/34; A47J 47/01
See application file for complete search history.

(56) References Cited

U.S. PATENT DOCUMENTS 183,555 A * 10/1876 Frazer ..... A47G 19/24 222/142.9
1,253,465 A * 1/1918 Carroll ..... A47G 19/24 222/542
1,267,564 A * 5/1918 Livingston ..... A47G 19/24 222/480
1,283,443 A * 10/1918 Parker ..... A47G 19/24 222/142.9
1,284,248 A * 11/1918 Crabtree ..... A47G 19/24 222/142.9
1,470,199 A * 10/1923 Small ..... A47J 27/13 220/23.88
1,896,976 A * 2/1933 Schifferdecker ..... G07D 9/02 220/253
2,144,981 A * 1/1939 Jones ..... A47G 19/24 222/142.7
2,335,016 A * 11/1943 Lorenzen ..... B65D 25/04 220/524
2,349,724 A * 5/1944 Henderson ..... B65D 47/265 222/548
2,354,004 A * 7/1944 Fess ..... A47G 19/24 222/563
2,469,034 A * 5/1949 Garris ..... B65D 47/265 220/532

(Continued)

FOREIGN PATENT DOCUMENTS

GB 2209115 5/1989

*Primary Examiner* — Paul R Durand
*Assistant Examiner* — Randall A Gruby

(57) ABSTRACT

A multiple chamber dispenser assembly for containing and dispensing spices includes a cylinder that has a pair of chambers each is integrated within the chamber to contain a respective granular spice. A strainer is integrated into the cylinder and the strainer extends partially across the cylinder such that the strainer defines an exposed portion of the opening extending into the cylinder. In this way the exposed portion of the opening facilitates each of the chambers to be filled with the respective granular spice. Furthermore, the strainer is foraminous to facilitate each of the chambers to dispense the respective granular spice through the strainer. A plurality of lids is each hingedly coupled to the cylinder and each of the lids is aligned with a respective one of the chambers for opening and closing the respective chamber.

7 Claims, 6 Drawing Sheets

(56) References Cited

U.S. PATENT DOCUMENTS 2,519,671 A * 8/1950 Law ..... A47G 19/24 222/545
2,590,437 A * 3/1952 Maves ..... A47G 19/24 222/561
2,652,951 A 9/1953 Esposito
2,812,115 A 11/1957 Pehr
3,081,926 A * 3/1963 Newton ..... B29D 23/00 229/5.83
3,217,949 A * 11/1965 Davis ..... B65D 47/0876 220/837
3,235,130 A * 2/1966 Waither ..... B65D 25/04 222/545
3,424,351 A * 1/1969 Walter, Jr. ..... B65D 83/06 426/115
3,737,075 A * 6/1973 Atchley ..... A47G 19/24 D7/596
3,831,743 A * 8/1974 Leedy ..... B65D 83/02 206/338
4,193,521 A 3/1980 Bounds
4,380,307 A * 4/1983 Stillinger ..... B65D 47/265 222/142.9
D278,602 S * 4/1985 Rosenstein ..... D9/449
4,522,315 A * 6/1985 Rapp ..... B65D 47/0876 222/565
4,611,725 A * 9/1986 Kacalieff ..... B65D 47/265 222/541.6
4,723,693 A * 2/1988 DeCoster ..... B65D 47/0876 222/545
4,792,054 A * 12/1988 Weidman ..... B65D 47/265 222/548
4,804,113 A 2/1989 Ciaccio
4,828,130 A * 5/1989 Hofmann ..... B65D 47/0876 215/DIG. 1
4,961,521 A * 10/1990 Eckman ..... A47G 19/24 222/545
5,219,100 A * 6/1993 Beck ..... B65D 47/0876 222/480
5,513,776 A * 5/1996 Canini ..... A47G 19/24 222/548
5,579,932 A * 12/1996 Drozd ..... B65D 50/041 220/255
D531,857 S 11/2006 Thomas
D550,557 S * 9/2007 Vogel ..... D9/440
D724,893 S * 3/2015 Dirks ..... D7/510
9,446,888 B2 9/2016 Mussio
10,562,693 B1 * 2/2020 Ambrezewicz .... B65D 47/0838
2007/0012726 A1 1/2007 Swindlehurst
2015/0158632 A1 * 6/2015 Wilhelm ..... B65D 47/263 426/120

* cited by examiner

MULTIPLE CHAMBER DISPENSER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to dispenser devices and more particularly pertains to a new dispenser device for storing a dispensing a plurality of different spices. The device includes a cylinder with a pair of chambers that each stores a respective spice. The device includes a foraminous strainer which partially covers each of the chambers. Additionally, the device includes a plurality of lids, each shaped to define a quadrant of a circle, which are each aligned with a respective chamber. A pair of the lids covers the strainer and a pair of the lids covers an exposed portion of a respective chamber. In this way respective lids can be opened to dispense spice through the strainer and respective lids can be opened for filling the respective chambers with spice. The prior art discloses a condiment bottle which has a plurality of chambers and a plurality of wedge shaped lids which each closes or opens a respective one of the chambers.

(2) Description of Related Art Including Information Disclosed Under 37 CFR 1.97 and 1.98

The prior art relates to dispenser devices including a salt and pepper shaker that includes a pair of button actuated dispensers for releasing either salt or pepper from respective chambers in the salt and pepper shaker. The prior art discloses a salt and pepper shaker that has a pair of chambers, each with a plurality of dispensing slots, and lid that is positioned on the salt and pepper shaker that can be tilted to expose the dispensing slots in a respective chamber. The prior art discloses a variety of salt and pepper shakers that each includes a plurality of chambers and a lid that is rotatably coupled to the salt and pepper shaker for opening a respective one of the chambers. The prior art discloses a multi-compartment storage container that has a plurality of chambers and a plurality of lids, each being hingedly coupled to a top wall of the storage container, for opening and closing respective chambers.

BRIEF SUMMARY OF THE INVENTION

An embodiment of the disclosure meets the needs presented above by generally comprising a cylinder that has a pair of chambers each is integrated within the chamber to contain a respective granular spice. A strainer is integrated into the cylinder and the strainer extends partially across the cylinder such that the strainer defines an exposed portion of the opening extending into the cylinder. In this way the exposed portion of the opening facilitates each of the chambers to be filled with the respective granular spice. Furthermore, the strainer is foraminous to facilitate each of the chambers to dispense the respective granular spice through the strainer. A plurality of lids is each hingedly coupled to the cylinder and each of the lids is aligned with a respective one of the chambers for opening and closing the respective chamber.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
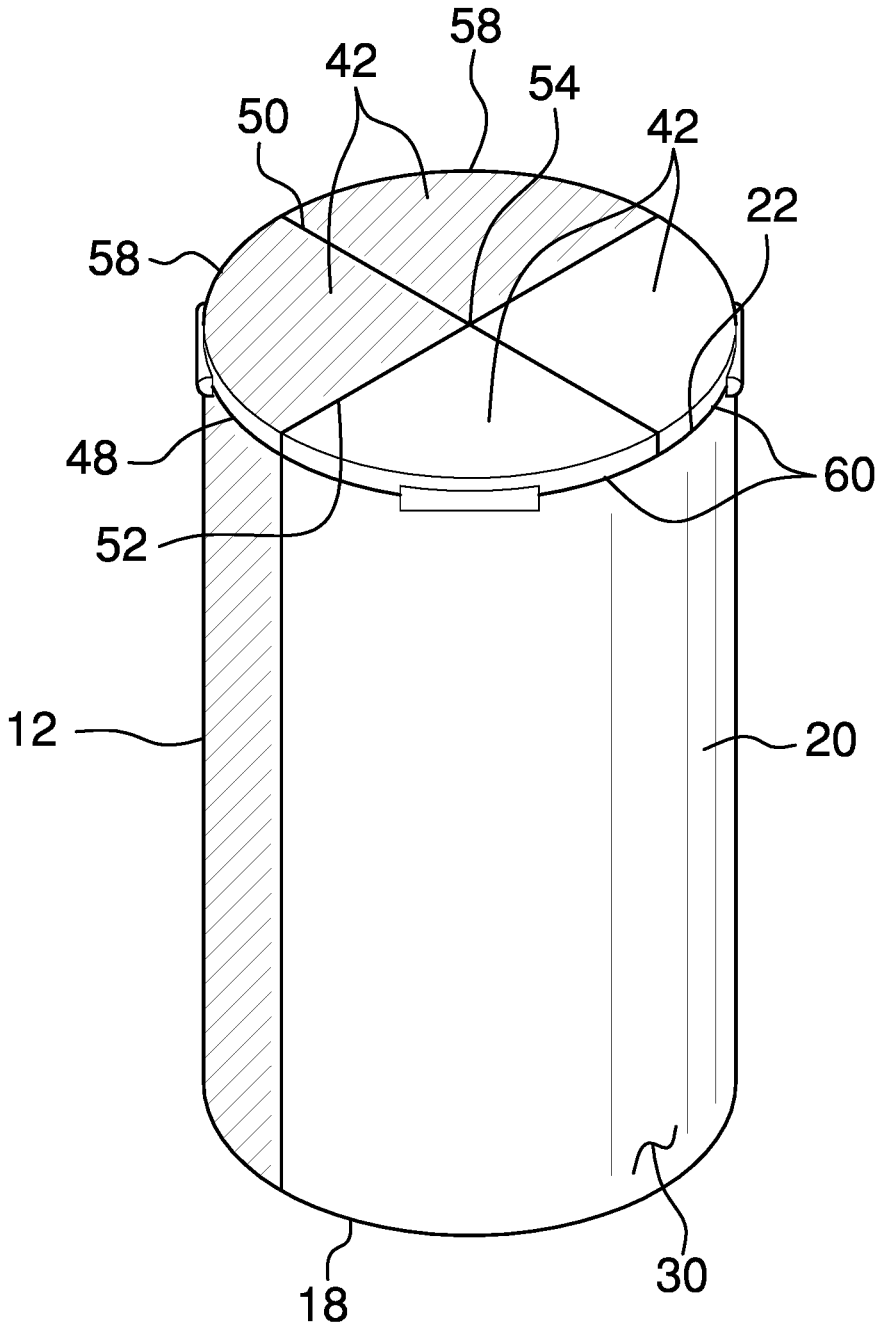
FIG. 1 is a top perspective view of a multiple chamber dispenser assembly according to an embodiment of the disclosure.
Figure 2:
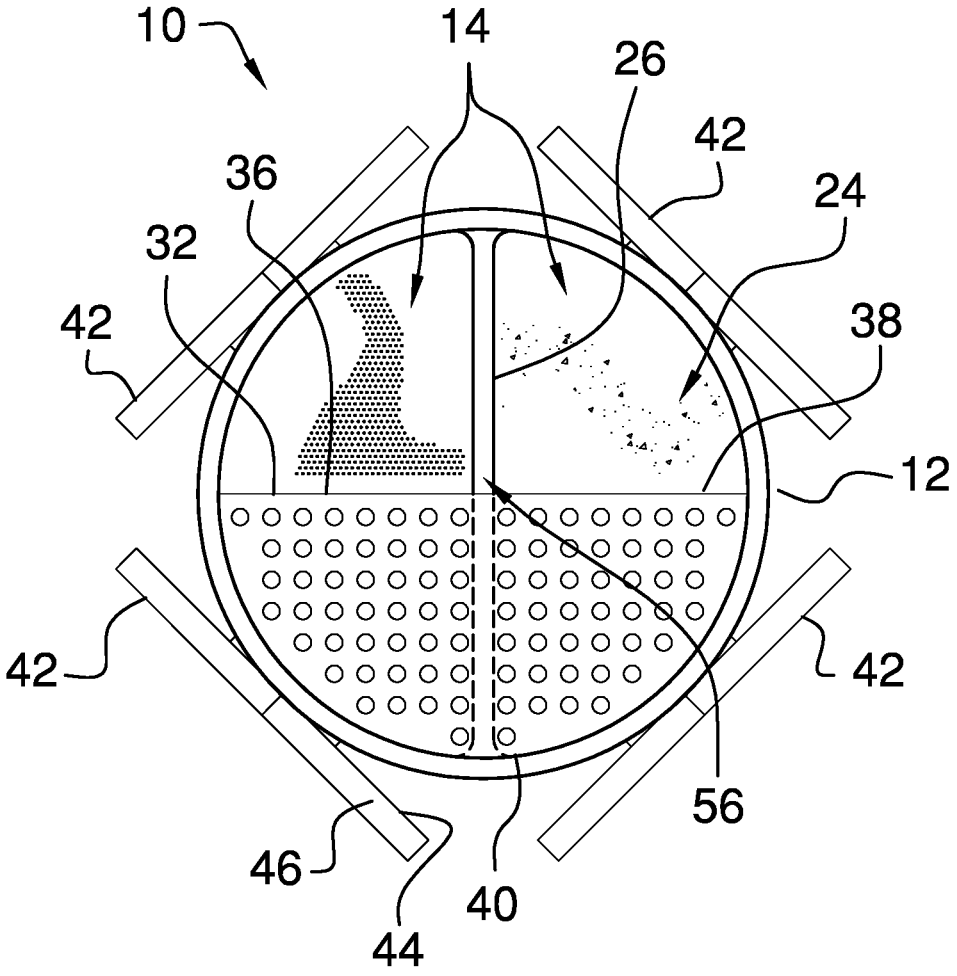
FIG. 2 is a top view of an embodiment of the disclosure.
Figure 3:
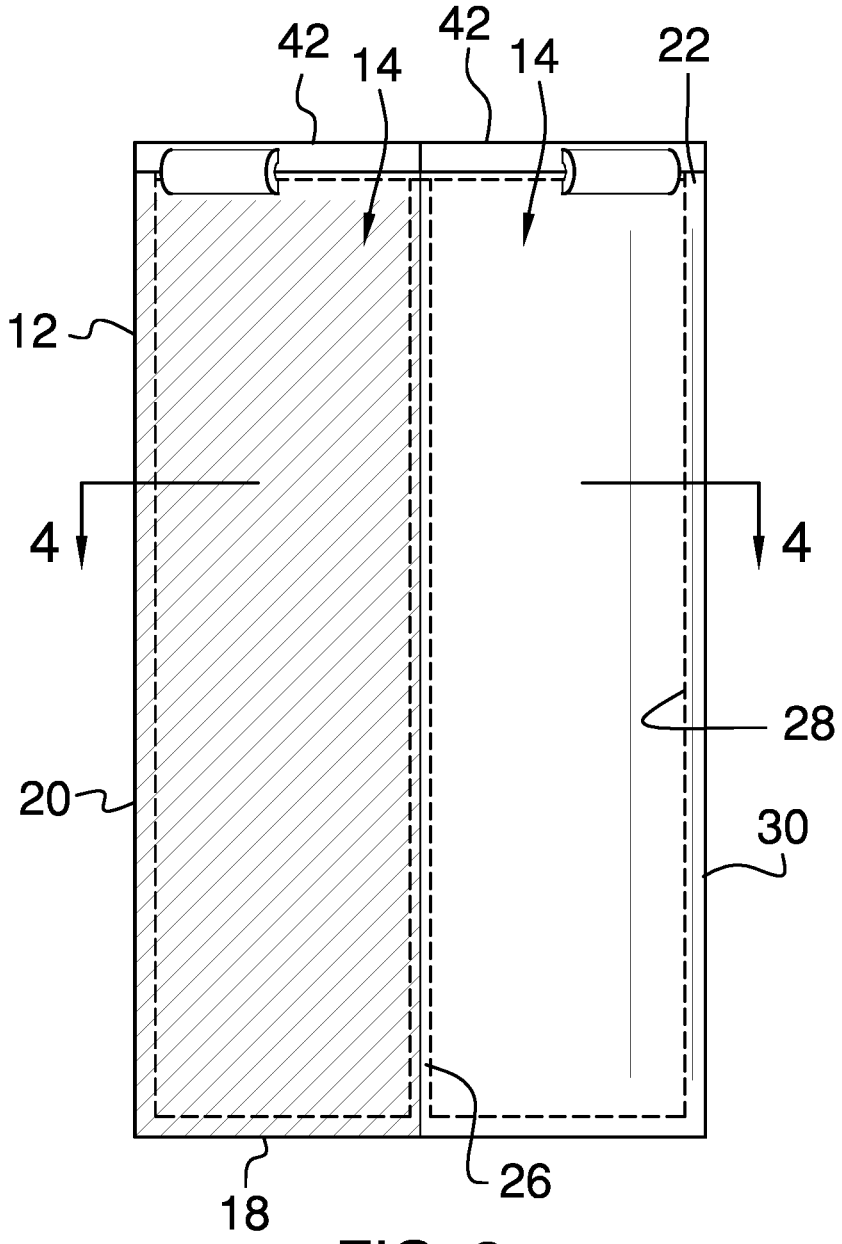
FIG. 3 is a front phantom view of an embodiment of the disclosure.
Figure 4:
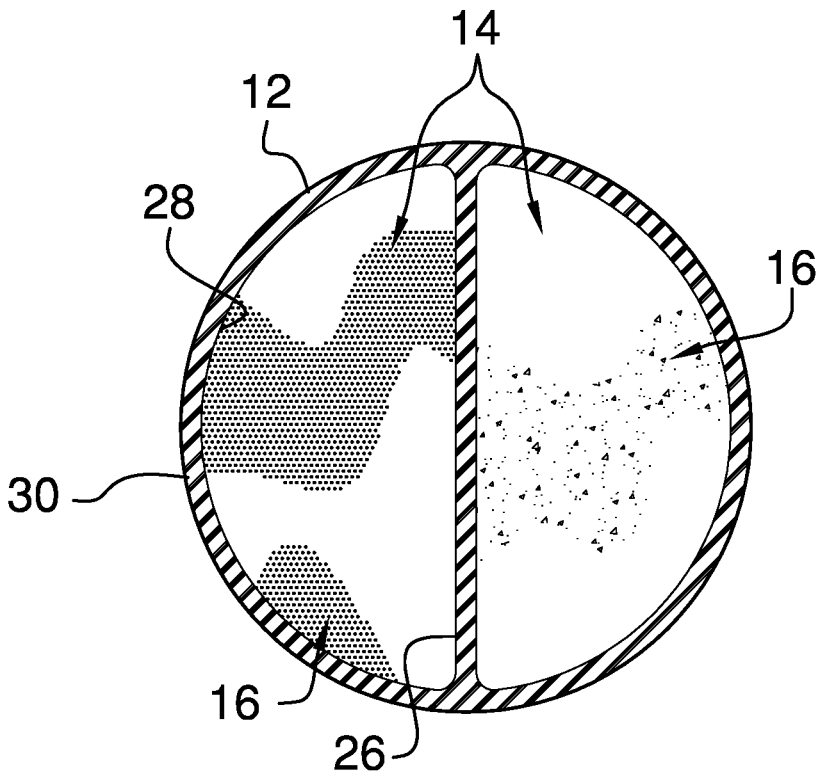
FIG. 4 is a cross sectional view taken along line 4-4 of FIG. 3 of an embodiment of the disclosure.
Figure 5:
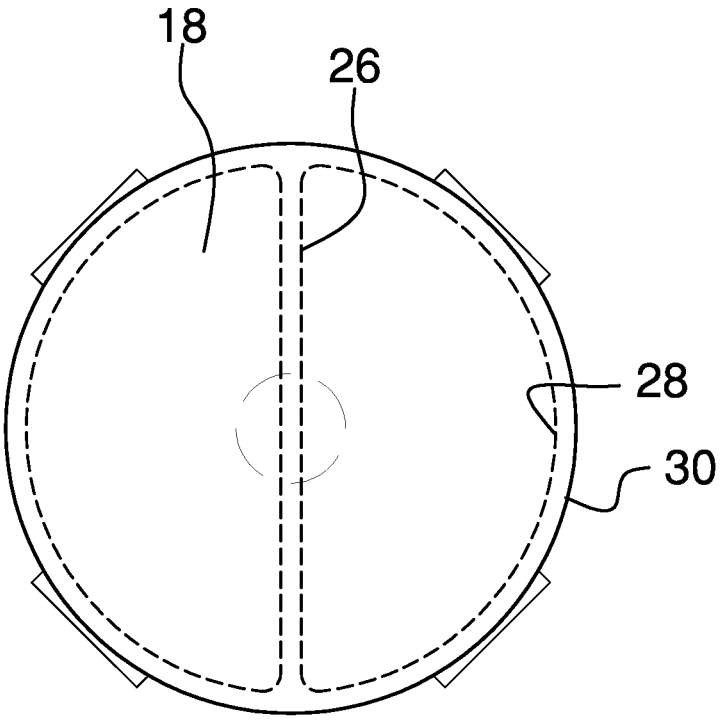
FIG. 5 is a bottom phantom view of an embodiment of the disclosure.
Figure 6:
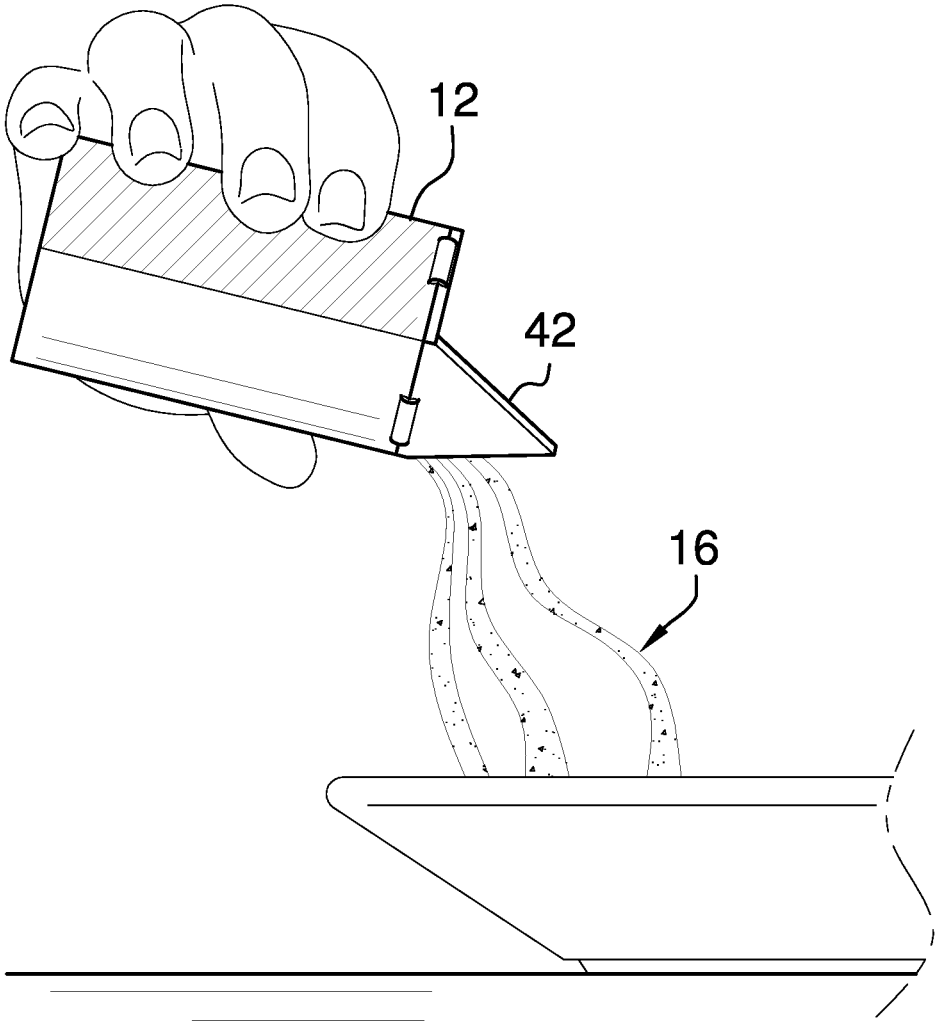
FIG. 6 is a perspective in-use view of an embodiment of the disclosure.

With reference now to the drawings, and in particular to FIGS. 1 through 6 thereof, a new dispenser device embodying the principles and concepts of an embodiment of the disclosure and generally designated by the reference numeral 10 will be described.

As best illustrated in FIGS. 1 through 6, the multiple chamber dispenser assembly 10 generally comprises a cylinder 12 has a pair of chambers 14 each integrated within the cylinder 12 such that each of the chambers 14 can contain a respective granular spice 16. The cylinder 12 has a bottom wall 18 and an outer wall 20 extending upwardly from the bottom wall 18, and the outer wall 20 has a distal edge 22 with respect to the bottom wall 18 defining an opening 24 into the cylinder 12. The cylinder 12 includes a dividing wall 26 that extends between the bottom wall 18 and the distal edge 22. The dividing wall 26 is centrally positioned within the cylinder 12 such that the dividing wall 26 defines each of the chambers 14 in the cylinder 12. Furthermore, the outer wall 20 has an inside surface 28 and an outside surface 30, and the dividing wall 26 extends between opposing sides of the inside surface 28 of the outer wall 20.

A strainer 32 is integrated into the cylinder 12 and the strainer 32 extends partially across the cylinder 12 such that the strainer 32 defines an exposed portion 34 of the opening 24 extending into the cylinder 12. In this way the exposed portion 34 of the opening 24 facilitates each of the chambers 14 to be filled with the respective granular spice 16. The strainer 32 is foraminous such that the strainer 32 facilitates each of the chambers 14 to dispense the respective granular spice 16 through the strainer 32. The strainer 32 has a perimeter edge 36 and the perimeter edge 36 has a first side 38 and a second side 40. The first side 38 extends along a straight line and the second side 40 is convexly arcuate with respect to the first side 38 such that the strainer 32 has a semicircular shape.

The second side 40 engages the inside surface 28 of the outer wall 20 of the cylinder 12. The strainer 32 is aligned with the distal edge 22 of the outer wall 20. Furthermore, the strainer 32 is oriented such that the first side 38 bisects the opening 24 defined by the distal edge 22 of the outer wall 20. The strainer 32 is oriented such that the first side 38 extends along a line that is perpendicularly oriented with the dividing wall 26. In this way each of the first side 38 and the dividing wall 26 divides the opening 24 defined by the distal edge 22 into quadrants.

A plurality of lids 42 is provided and each of the lids 42 is hingedly coupled to the cylinder 12. Each of the lids 42 is aligned with a respective one of the chambers 14 and each of the lids 42 is positionable in a closed position for closing the respective chamber 14. Furthermore, each of the lids 42 is positionable in an open position for opening 24 the respective chamber 14. Each of the lids 42 has a lower surface 44 and an exterior edge 46, and the exterior edge 46 of each of the lids 42 has a primary side 48, a secondary side 50 and a tertiary side 52. The primary side 48 extends between each of the secondary side 50 and the tertiary side 52, and the secondary side 50 and the tertiary side 52 intersect at a point 54. The primary side 48 is convexly arcuate with respect to the point 54 such that each of the lids 42 defines a sector of a circle.

The secondary side 50 of the perimeter edge 36 of each of the lids 42 is hingedly coupled to the outside surface 30 of the outer wall 20 of the cylinder 12. Additionally, each of the lids 42 is aligned with a respective one of the quadrants defined by strainer 32 and the dividing wall 26. The lower surface 44 of each of the lids 42 rests on the strainer 32 when the lids 42 are positioned in the closed position. The point 54 defined on each of the lids 42 intersects at a central point 56 on the opening 24 defined by the distal edge 22 of the outer wall 20 of the cylinder 12 when the lids 42 are positioned in a closed position. As is most clearly shown in FIGS. 1, 3 and 6, the plurality of lids 42 includes a pair of first lids 58 and a pair of second lids 60. Each of the first lids 58 has a color that is distinct from the pair of second lids 60 and a respective portion of the outer wall 20 of the cylinder 12 has a color that matches the color of the first lids 58. Furthermore, each of the first lids 58 is associated with a respective one of the chambers 14 in the cylinder 12 and each of the second lids 60 is associated with a respective one of the chambers 14. In this way the spices 16 that are contained in the respective chambers 14 can be visually identified.

In use, each of the first lid 58 and the second lid 60 that is aligned with the exposed portion 34 of the opening 24 into the interior of the cylinder 12 is opened to facilitate the chambers 14 in the cylinder 12 to be filled with a respective spice 16. Each of the first lid 58 and the second lid 60 that is aligned with the exposed portion 34 of the opening 24 into the interior of the cylinder 12 is closed to contain the spices 16. The first lid 58 that is aligned with the strainer 32 is opened to dispense the spices 16 contained in the chamber 14 that is aligned with the first lid 58. Furthermore, the second lid 60 that is aligned with the strainer 32 is opened to dispense the spices 16 contained in the chamber 14 that is aligned with the second lid 60. In this way the spices 16 contained in each chamber 14 can be independently dispensed or simultaneously dispensed, depending on the user's preference.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A multiple chamber dispenser assembly for storing and dispensing a plurality of spices, said assembly comprising:

a cylinder having a pair of chambers wherein each of said chambers is configured to contain a respective granular spice;

a strainer being integrated into said cylinder, said strainer extending partially across said cylinder such that said strainer defines an exposed portion of an opening extending into said cylinder wherein said exposed portion of said opening is configured to facilitate each of said chambers to be filled with the respective granular spice, said strainer being foraminous such that said strainer is configured to facilitate each of said chambers to dispense the respective granular spice through said strainer;

a plurality of lids, each of said lids being hingedly coupled to said cylinder, each of said lids being aligned with a respective one of said chambers, each of said lids being positionable in a closed position for closing said respective chamber, each of said lids being positionable in an open position for opening said respective chamber;

wherein said cylinder has a bottom wall and an outer wall extending upwardly from said bottom wall, said outer wall having a distal edge with respect to said bottom wall defining said opening into said cylinder, said cylinder including a dividing wall extending between said bottom wall and said distal edge, said dividing wall being centrally positioned within said cylinder such that said dividing wall defines each of said chambers in said cylinder, said outer wall having an outside surface; and wherein each of said lids has a lower surface and an exterior edge, said exterior edge of each of said lids having a primary side, a secondary side and a tertiary side, said primary side extending between each of said secondary side and said tertiary side, said secondary side and said tertiary side intersecting at a point, said primary side being convexly arcuate with respect to said point such that each of said lids defines a sector of a circle, said secondary side of said exterior edge of each of said lids is hingedly coupled to said outside surface of said outer wall of said cylinder, said lower surface of each of said lids resting on said strainer when said lids are positioned in said closed position.

2. The assembly according to claim 1, wherein said outer wall has an inside surface, said dividing wall extending between opposing sides of said inside surface of said outer wall.

3. The assembly according to claim 2, wherein said strainer has a perimeter edge, said perimeter edge having a first side and a second side, said first side extending along a straight line, said second side being convexly arcuate with respect to said first side such that said strainer has a semicircular shape, said second side engaging said inside surface of said outer wall of said cylinder, said strainer being aligned with said distal edge of said outer wall.

4. The assembly according to claim 3, wherein said strainer is oriented such that said first side bisects said opening defined by said distal edge of said outer wall.

5. The assembly according to claim 3, wherein said strainer is oriented such that said first side extends along a line being perpendicularly oriented with said dividing wall such that each of said first side and said dividing wall divides said opening defined by said distal edge into quadrants.

6. The assembly according to claim 1, wherein:

said strainer has a perimeter edge, said perimeter edge having a first side and a second side, said strainer being oriented such that said first side extends along a line being perpendicularly oriented with said dividing wall such that each of said first side and said dividing wall divides said opening defined by said distal edge into quadrants; and each of said lids is aligned with a respective one of said quadrants defined by strainer and said dividing wall, said point defined on each of said lids intersecting at a central point on said opening defined by said distal edge of said outer wall of said cylinder when said lids are positioned in a closed position.

7. A multiple chamber dispenser assembly for storing and dispensing a plurality of spices, said assembly comprising:

a cylinder having a pair of chambers wherein each of said chambers is configured to contain a respective granular spice, said cylinder having a bottom wall and an outer wall extending upwardly from said bottom wall, said outer wall having a distal edge with respect to said bottom wall defining an opening into said cylinder, said cylinder including a dividing wall extending between said bottom wall and said distal edge, said dividing wall being centrally positioned within said cylinder such that said dividing wall defines each of said chambers in said cylinder, said outer wall having an inside surface and an outside surface, said dividing wall extending between opposing sides of said inside surface of said outer wall;

a strainer being integrated into said cylinder, said strainer extending partially across said cylinder such that said strainer defines an exposed portion of said opening extending into said cylinder wherein said exposed portion of said opening is configured to facilitate each of said chambers to be filled with the respective granular spice, said strainer being foraminous such that said strainer is configured to facilitate each of said chambers to dispense the respective granular spice through said strainer, said strainer having a perimeter edge, said perimeter edge having a first side and a second side, said first side extending along a straight line, said second side being convexly arcuate with respect to said first side such that said strainer has a semicircular shape, said second side engaging said inside surface of said outer wall of said cylinder, said strainer being aligned with said distal edge of said outer wall, said strainer being oriented such that said first side bisects said opening defined by said distal edge of said outer wall, said strainer being oriented such that said first side extends along a line being perpendicularly oriented with said dividing wall such that each of said first side and said dividing wall divides said opening defined by said distal edge into quadrants; and a plurality of lids, each of said lids being hingedly coupled to said cylinder, each of said lids being aligned with a respective one of said chambers, each of said lids being positionable in a closed position for closing said respective chamber, each of said lids being positionable in an open position for opening said respective chamber, each of said lids having a lower surface and an exterior edge, said exterior edge of each of said lids having a primary side, a secondary side and a tertiary side, said primary side extending between each of said secondary side and said tertiary side, said secondary side and said tertiary side intersecting at a point, said primary side being convexly arcuate with respect to said point such that each of said lids defines a sector of a circle, said secondary side of said perimeter edge of each of said lids being hingedly coupled to said outside surface of said outer wall of said cylinder, said lower surface of each of said lids resting on said strainer when said lids are positioned in said closed position, each of said lids being aligned with a respective one of said quadrants defined by strainer and said dividing wall, said point defined on each of said lids intersecting at a central point on said opening defined by said distal edge of said outer wall of said cylinder when said lids are positioned in a closed position.

* * * * *